US005575142A

United States Patent [19]

Munnekehoff

[11] Patent Number: 5,575,142

[45] Date of Patent: Nov. 19, 1996

[54] METHOD OF AUTOMATICALLY SERVICING WINDING APPARATUS IN MULTI-STATION TEXTILE MACHINES

[75] Inventor: Gerd Munnekehoff, Remscheid, Germany

[73] Assignee: Barmag AG, Remscheid, Germany

[21] Appl. No.: 210,350

[22] Filed: Mar. 18, 1994

Related U.S. Application Data

[63] Continuation of Ser. No. 763,174, Sep. 20, 1991, abandoned.

[30] Foreign Application Priority Data

Sep. 21, 1990 [DE] Germany ..... 40 29 924.4

[51] Int. Cl.[6] ..... D01H 9/10; D01H 9/14

[52] U.S. Cl. ..... 57/281; 57/90; 57/268; 242/35.5 A

[58] Field of Search ..... 57/90, 281, 268; 242/35.5 A

[56] References Cited

U.S. PATENT DOCUMENTS

| | | | |
|---|---|---|---|
| 3,685,752 | 8/1972 | Wirz | 242/36 |
| 3,746,233 | 7/1973 | Bauer et al. | 226/194 |
| 3,791,126 | 2/1974 | Kose et al. | 57/53 |
| 3,807,270 | 4/1974 | Wirz | 83/571 |
| 3,815,836 | 6/1974 | Münnekehoff et al. | 242/46.4 |
| 3,820,730 | 6/1974 | Endo et al. | 242/35.5 R |
| 3,861,007 | 1/1975 | Schippers et al. | 242/43 |
| 3,895,725 | 7/1975 | Mayer | 214/41 |
| 3,915,398 | 10/1975 | Corl | 242/35.5 A |
| 3,917,182 | 11/1975 | Lenk | 242/18 R |
| 3,945,581 | 3/1976 | Schippers et al. | 242/43 |
| 3,974,973 | 8/1976 | Lenk et al. | 242/41 |
| 3,987,974 | 10/1976 | Mayer | 242/35.5 A |
| 4,007,882 | 2/1977 | Isoard | 242/18 R |
| 4,012,893 | 3/1977 | Weber | 57/281 |
| 4,023,339 | 5/1977 | Laderach et al. | 57/281 X |
| 4,023,743 | 5/1977 | Schippers | 242/35.5 A |
| 4,041,686 | 8/1977 | Inaba et al. | 57/34 R |
| 4,052,017 | 10/1977 | Schär | 242/35.5 A |
| 4,069,983 | 1/1978 | Muramatsu et al. | 242/18 PW |
| 4,079,898 | 3/1978 | Murakami et al. | 242/35.5 A |
| 4,116,395 | 9/1978 | Courvoiser | 242/35.5 A |
| 4,138,072 | 2/1979 | Aoyama et al. | 242/35.5 A |
| 4,153,211 | 5/1979 | Lenk et al. | 242/35.5 A |
| 4,175,712 | 11/1979 | Schippers et al. | 242/46.4 |
| 4,223,849 | 9/1980 | Schippers et al. | 242/46.4 |
| 4,226,567 | 10/1980 | Van Orsdale, Jr. | 414/555 |
| 4,340,187 | 7/1982 | Schippers et al. | 242/35.5 A |
| 4,351,494 | 9/1982 | Schippers et al. | 242/35.5 A |
| 4,619,404 | 9/1986 | Maccaferri | 242/35.5 A |
| 4,638,955 | 1/1987 | Schippers et al. | 242/18 PW |
| 4,987,649 | 1/1991 | Meyer et al. | 19/159 A |
| 4,999,988 | 3/1991 | Roder et al. | 57/90 X |
| 5,172,541 | 12/1992 | Schmalz | 57/90 X |
| 5,257,897 | 11/1993 | Yamamoto et al. | 57/281 |
| 5,365,728 | 11/1994 | Mack | 57/281 |
| 5,393,003 | 2/1995 | Watermann | 242/35.5 A |

FOREIGN PATENT DOCUMENTS

| | | |
|---|---|---|
| 0479063 | 9/1991 | European Pat. Off. . |
| 2526768 | 12/1976 | Germany . |
| 2719853 | 1/1980 | Germany . |
| 2937620 | 5/1980 | Germany . |
| 51-130347 | 6/1975 | Japan . |
| 51-144521 | 11/1976 | Japan . |
| 870402 | 6/1961 | United Kingdom . |
| 1399891 | 7/1975 | United Kingdom . |

*Primary Examiner*—William Stryjewski
*Attorney, Agent, or Firm*—Bell, Seltzer, Park & Gibson, P.A.

[57] ABSTRACT

A method of servicing the individual winding stations of a multi-station winding machine, and wherein a plurality of identically equipped service carts is provided in a parking track, and such that upon receiving a call signal, each service cart may be moved from the parking track and along a service track and to the winding station which issued the call. The cart is then adapted to service the winding station, such as by doffing full yarn packages. The cart then may be moved to a transfer position where the full packages are received from the service cart for packing, or transport to a further processing machine.

12 Claims, 1 Drawing Sheet

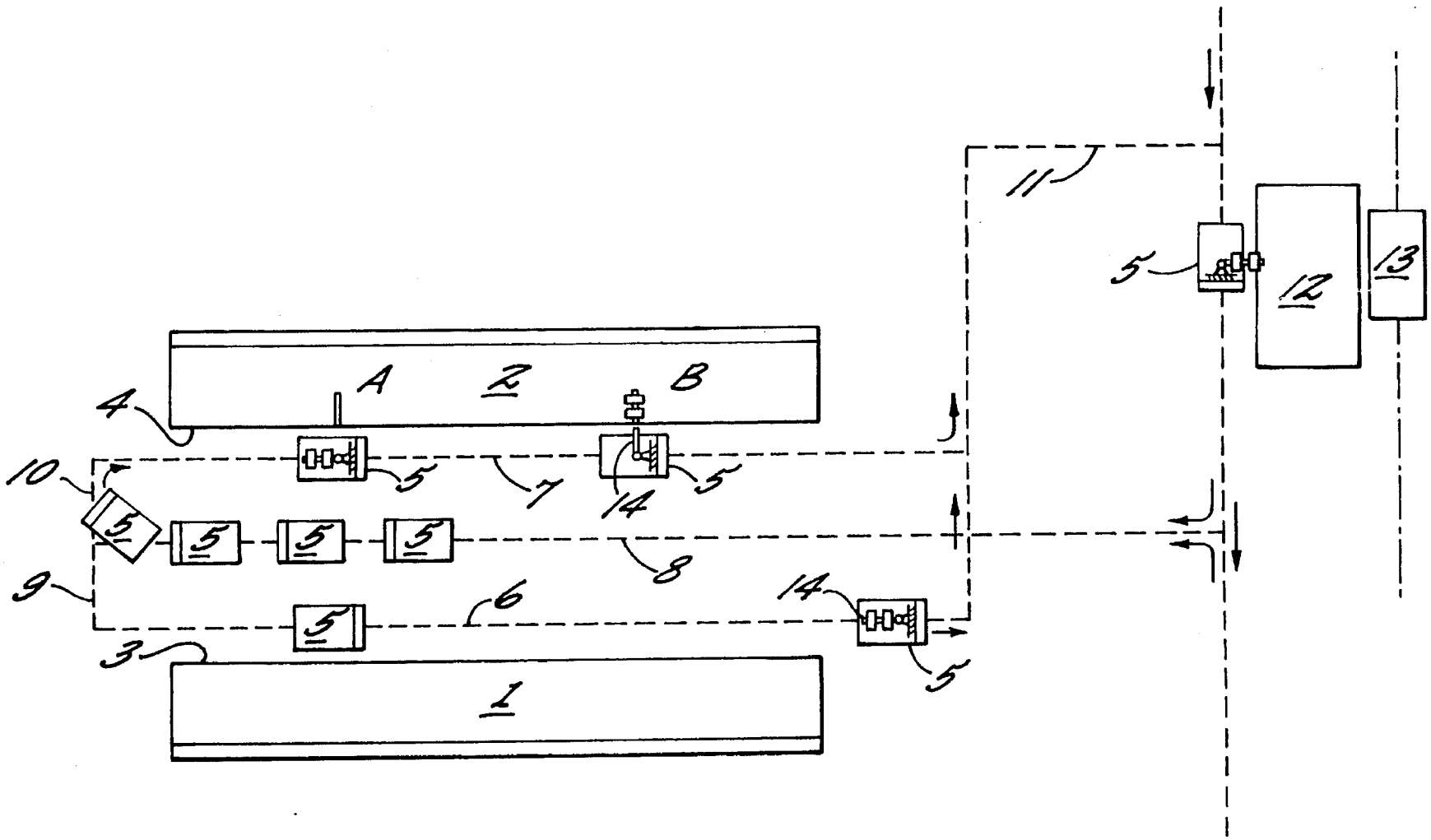
13
12
5
11
5
14
B
5
14
8
7
2
6
1
A
5
5
5
5
4
3
10
9

METHOD OF AUTOMATICALLY SERVICING WINDING APPARATUS IN MULTI-STATION TEXTILE MACHINES

CROSS REFERENCE TO RELATED APPLICATION

This application claims the benefit under 35 USC § 120, which is a continuation of U.S. application Ser. No. 07/763,174 filed Sep. 20, 1991, and now abandoned.

BACKGROUND OF THE INVENTION

The invention relates to a method of automatically servicing winding apparatus in multi-station textile machines and, more particularly, to a method of moving a plurality of doffing carts in a track extending along the front of a textile machine, to be positioned at any one of the winding stations for the purpose of receiving completed or finished bobbins from the winding spindles of the winding station and/or for delivering empty spools to the winding spindles of the winding station.

A winding apparatus servicing method of the described type is known from U.S. Pat. No. 3,895,725. In accordance with the known method a doffing cart is provided which assumes the functions of receiving completed bobbins from all of the winding stations of a multi-station textile machine as well as of delivering empty spools to the winding stations of the machine. In accordance with the method, completed bobbins are transferred directly from the doffing cart to a movable transport frame, the deposit positions of which are arranged in a substantially matching relationship to the winding stations of the textile machine.

If, however, unforeseen yarn breaks occur or if, instead of being changed at predetermined intervals, the bobbins are randomly changed, the demand on the doffing cart may be such that the winding stations may not always be serviced in time. This puts a serious limitation on the efficiency or extent to which the textile machine may be used. Only by having a small number of winding stations associated with each doffing cart may the level of efficiency be raised. However, failures may occur even then. The service time available to the doffing cart is further limited by the fact that the transport frame requires changing whenever it is fully loaded or in case loaded positions have to be serviced again. In any event, mechanically or electrically induced failures of a doffing cart require that the textile machine be either turned off or manually serviced.

The above disadvantage is unavoidable even in the theoretical case in which each winding station of the textile machine is provided with its own doffing cart. The disadvantages are, moreover, compounded by the fact that the known doffing cart assumes the function of yarn handling.

U.S. Pat. No. 4,340,187 discloses a bobbin changing apparatus in which the several operations have been divided. Completed bobbins are transferred to, and removed by, a first bobbin cart, while another doffing cart assumes the function of yarn handling during the exchange of bobbins. Even this system, however, does not permit full, i.e. 100%, utilization of the machine.

SUMMARY OF THE INVENTION

It is an object of the present invention to provide for a method of automatically servicing a yarn winding apparatus comprising a multi-station textile machine, which permits full utilization of the machine without unreasonable difficulties.

In accordance with the invention a plurality of identically equipped doffing carts is provided in a parking track, where they are maintained in a state of readiness for servicing a group of winding apparatus. When a winding station needs to be serviced, it sends a call signal to a doffing cart positioned at the parking track, and the signalled cart moves in response to the call signal to the associated winding station. To facilitate the movement of the carts, each cart is provided with a separate drive motor which is powered for example by a re-chargeable battery.

Upon reaching the winding station which has issued the call signal, the cart is caused to service the station, such as by doffing a full package or donning a winding tube. The cart then moves to a transfer station where it is refurbished. The cart then returns to the parking track.

The method of the present invention differs from the kind of arrangement in which a plurality of working positions and their winding apparatus are subdivided into small groups with a doffing cart being associated with each group. In accordance with the invention all the doffing carts may be used at any one of the winding stations located along the front of the machine. By means of a suitable early warning system interference of doffing carts by other doffing carts positioned in the track of movement may be prevented.

In accordance with an advantageous feature of the invention full utilization of the machine is possible, because the number of doffing carts kept in readiness may be adjusted in accordance with demand.

The demand is dependent upon the winding time of the bobbins, potential yarn breakage, the time it takes for bobbins to be exchanged, and the frequency at which a doffing cart needs repairing. Break-down of any doffing cart is of no consequence to the operation of the machine, since a sufficient number of doffing carts are maintained in a state of preparedness at all times.

It is a further object of the invention to maintain as few doffing carts as possible in a state of preparedness by connecting the service and/or parking tracks of any machine to service and parking tracks of other textile machines. It is of special advantage to service parallel rows of winding stations from a parking track located between them. In accordance with the invention each doffing cart, after being loaded with a complete bobbin, is moved to a transfer station, where the bobbin is transferred from the doffing cart to the transfer station for transfer to a further transport device without further assistance from the doffing cart. The latter transfer may take place at the requisite elevation and in proper orientation. The complete bobbin may also be packed or stored on a pallet. Essential time consuming aspects of the bobbin exchange operation otherwise carried out by the doffing cart are now delegated to the transfer station. Hence, the transfer station puts individual bobbins received from individual doffing carts into a position suitable for removal. Removal may take place by another transport apparatus in which case the transfer station places and aligns the bobbins at the elevational level required by the succeeding transport apparatus. In respect of the orientation or alignment of each bobbin, care must be taken to put the yarn leader of each bobbin into a predetermined position. This is of crucial importance where the bobbin is to be processed in a succeeding machine. Where transfer of the bobbin from one transport apparatus to another takes place by sliding it from one support arm to another support arm, the number of transfer operations determines the position of the yarn leader. This may require turning the bobbin in such a way that its axial ends are reversed.

The transfer stations may further be utilized for packing the bobbins into boxes or placing them on pallets.

Advantageously, one end of the parking track is connected to a service track of the machine, whereas the other end of the parking track may be connected with a transfer station and/or other service tracks of other textile machines. Such an arrangement facilitates an orderly unimpeded servicing of the machines, since doffing carts are moved into a service track from one end thereof whereas they leave the service track at the other end of the service track.

BRIEF DESCRIPTION OF THE DRAWINGS

An embodiment of the invention will now be described with reference to the accompanying drawing, which is a schematic plan view of a textile processing plant which incorporates the present invention.

DETAILED DESCRIPTION OF THE INVENTION

Schematically depicted textile machines 1 and 2 are placed in parallel relationship to each other in such a manner that their service fronts 3 and 4 face each other. Each machine front 3 and 4 is provided with a plurality of winding stations, all of which are positioned in the same horizontal plane. Two of these winding stations have been schematically shown at A and B, it being understood that there may, for instance, be as many as 108 of them. As shown, bobbins have just been taken off station A and are about to be taken off station B. Each winding station may include a winding spindle cantilevered in the direction of the service aisle provided between the two machine fronts 3 and 4, each winding spindle being suited to accommodate one or more bobbins. For exchanging the bobbins they are axially moved from the spindle to a support arm 14 mounted on the doffing carts 5 at the same level as the winding spindle.

Service tracks 6 and 7 are provided between the machine fronts 3 and 4 and extend parallel to each other and to the immediately adjacent machine fronts. Running parallel between the service tracks 6 and 7, there is provided a parking track 8. The parking track 8 is connected to the left ends of the service tracks 6 and 7 by way of connecting tracks 9 and 10. As shown in the drawing, three doffing carts 5 are positioned in parking track 8. Another doffing cart 5 is shown at a position where it enters the connecting track 10 to be moved to the service track 7. As shown, two doffing carts 5 are positioned in the service track 7, one of the carts having just taken two bobbins off the winding spindle of station A, the other cart having moved into position to take full bobbins off the spindle of station B. New empty bobbin tubes (not shown) may be placed on the spindles as well. Still another doffing cart 5 is shown to have moved from the parking track 8 to the service track 6, so that a winding station of the textile machine 1 may be serviced. Yet another doffing cart 5 loaded with bobbins is about to leave the service track 6 to move to a transfer station 12 by way of a connecting track 11. Another doffing cart 5 is shown at the transfer station 12 in position for unloading. The transfer station for this purpose may be provided with a vertically movable bobbin support arm (not shown). For receiving bobbins, the support arm is moved to the level of the support arm on the doffing cart 5. In this respect, it should be noted that the elevational position of the support arms provided on the doffing carts 5 is fixed thus making the structure of the carts 5 as simple as possible. The bobbins are pushed, manually or automatically, as the case may be, from the support arm of the doffing cart 5 to the support arm provided in the transfer station 12. Once in the transfer station 12, the bobbins may be raised or lowered to a level suitable for loading onto the transport device 13. That is to say, the transport device 13 is loaded by the transfer device 12. The transport device 13 serves to move the bobbins within a factory and may, therefore, have a large capacity. Once unloaded, the doffing cart 5 may return to the parking track 8 servicing the two textile machines 1 and 2, or it may be moved to a parking track of any other textile machine. At increased levels of demand it would be possible to move doffing carts into the parking track 8 from other machines. Furthermore, it is possible to load the transfer station 12 from doffing carts 5 coming from other textile machines.

As mentioned above, for purposes of a simple structure of the doffing carts 5, the elevational position of the support arms 14 cannot be changed. However, they may be pivoted relative to the machine fronts 3 and 4.

Each individual doffing cart 5 is preferably separately driven by an electric motor which is powered by a rechargeable battery, and thus the carts are movable independently of each other. The battery may be connected at the parking track 8 with a suitable charging device. Also, the winding stations are each designed to issue a call signal, such as by radio telemetry, to the doffing carts waiting in the parking track 8 shortly before the scheduled winding is completed. The signalled cart then individually moves to the winding station which issued the call for the purpose of refurbishing the station.

In the drawings and specification, there has been set forth a preferred embodiment of the invention, and although specific terms are employed, they are used in a generic and descriptive sense only and not for purposes of limitation.

What is claimed is:

1. A method of automatically servicing a textile machine comprising a plurality of winding stations in a predetermined spatial relationship, the method comprising the steps of:

parking not less than two identically equipped service carts in a state of service preparedness in a first position;

issuing a call signal to one of the service carts at said first position from one of said winding stations upon a serviceable condition existing at the one signal issuing station;

moving said one service cart in response to the call signal to the one winding station which issued the call signal;

servicing the one winding station which issued the call signal by said one service cart;

moving said one service cart from said one winding station to a second position;

refurbishing said state of service preparedness of said one service cart at said second position; and moving said one service cart from said second position back to said first position.

2. The method of claim 1, wherein said step of servicing the one winding station which issued the call signal includes doffing a complete yarn package.

3. The method of claim 1, wherein said step of servicing the one winding station which issued the call signal includes donning an empty winding tube.

4. The method of claim 1, wherein said one service cart is moved along a predetermined closed path which includes said first position, a further position extending along said plurality of winding stations, and said second position.

5. The method of claim 4, wherein movement along said predetermined closed path includes movement along a track system.

6. The method of claim 1, wherein said one service cart is moved along a predetermined path and wherein movement of said one service cart from said first position to said one winding station includes movement from a first section of said path to one of two path sections connected to said first section thereof.

7. The method of claim 6, wherein movement of said one service cart from said winding station to said second position includes moving said one service cart from said one of said two path sections to a third section of said path which is in turn connected to said first and said two path sections thereof.

8. The method of claim 7, wherein movement of said one service cart from said second position back to said first position includes moving said service cart from said third section to said first section of said path.

9. A method of servicing a textile machine having a plurality of winding stations arranged in side-by-side relationship, comprising the steps of:

parking a plurality of service carts at a parking position thereof;

issuing a call signal to the service carts at said parking track segment from each winding station upon a substantially full yarn package existing at the signal issuing station;

moving a service cart in response to each call signal from said parking position to a service position adjacent the winding station having the substantially full yarn package;

moving the full yarn package from said winding station onto said service cart;

moving said service cart from said service position to a transfer position;

unloading the full yarn package from said service cart onto a transfer frame located at said transfer position; and moving said service cart back to said parking position.

10. A method of servicing a textile yarn processing machine which comprises a plurality of winding stations arranged in a side-by-side relationship;

a transfer station spaced from said plurality of winding stations;

a track system in the form of a closed loop and including a parking track segment, a service track segment, and a connecting track segment, with said service track segment extending along said side-by-side winding stations, and with said connecting track segment extending along said transfer station;

a plurality of identically equipped and independently driven service carts moveable in a loop along said track system, and comprising the steps of parking a plurality of said service carts at said parking track segment;

issuing a call signal to the service carts at said parking track segment from each winding station upon a serviceable condition existing at the signal issuing station;

moving an individual one of said service carts in response to each call signal along said track system to said service track segment and adjacent the signal issuing winding station;

servicing said signal issuing winding station by said one service cart;

moving said one service cart along said track system from said service track segment to said connecting track segment and to a position adjacent said transfer station;

refurbishing said one service cart by interacting with said transfer station, and then moving said one service cart along said track system back to said parking track segment.

11. The method as defined in claim 10 wherein the step of causing said one service cart to service said signal issuing winding station includes transferring a full yarn package from said winding station to said one service cart, and wherein the step of causing said one service cart to interact with said transfer station includes transferring the full yarn package from said one service cart to said transfer station.

12. The method as defined in claim 10 wherein the step of causing said one service cart to service said signal issuing winding station includes transferring an empty yarn bobbin tube from said one service cart to said winding station, and wherein the step of causing said one service cart to interact with said transfer station includes transferring an empty yarn bobbin tube to said one service cart from said transfer station.

* * * * *